US010343812B2

(12) United States Patent
Zhu

(10) Patent No.: US 10,343,812 B2
(45) Date of Patent: Jul. 9, 2019

(54) DISPLAY BOX WITH RETENTION MEANS

(71) Applicant: The Procter & Gamble Company, Cincinnati, OH (US)

(72) Inventor: Dan Zhu, Beijing (CN)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 15/620,932

(22) Filed: Jun. 13, 2017

(65) Prior Publication Data

US 2018/0022500 A1 Jan. 25, 2018

(30) Foreign Application Priority Data

Jun. 13, 2016 (WO) ..... PCT/CN2016/085552

(51) Int. Cl.

*B65D 5/50* (2006.01)
*B65D 5/02* (2006.01)
*B65D 5/42* (2006.01)

(52) U.S. Cl.

CPC ..... *B65D 5/5016* (2013.01); *B65D 5/0254* (2013.01); *B65D 5/4204* (2013.01); *B65D 5/5014* (2013.01)

(58) Field of Classification Search

CPC ..... B65D 5/468; B65D 7/16; B65D 5/024; B65D 5/4237; B65D 5/4445; B65D 25/54;

(Continued)

(56) References Cited

U.S. PATENT DOCUMENTS 4,236,662 A * 12/1980 Roccaforte ..... B65D 5/3621 206/418
5,145,070 A 9/1992 Pallett (Continued)

FOREIGN PATENT DOCUMENTS

CN 201694447 1/2011
CN 102991885 A 3/2013

(Continued)

OTHER PUBLICATIONS

International Search Report and Written Opinion of the International Searching Authority, PCT/CN2016/085552, dated Mar. 3, 2017, 14 pages.

(Continued)

*Primary Examiner* — J. Gregory Pickett
*Assistant Examiner* — Tia Cox
(74) *Attorney, Agent, or Firm* — John G. Powell

(57) ABSTRACT

A display box is provided for housing and retaining a cylindrical container. The box may include two side walls and a front and rear wall, a top lid extending from an upper end of one of the walls and a bottom lid extending from the lower end of the same or a different wall. At least one elongate flap further extends from the lower end of one of said side walls or rear wall, said flap being provided with crease lines along which said flap may be folded. The flap has an end portion adhered to the inner surface of the wall from which the flap extends, a first lateral portion having a proximal end adjacent the wall and a distal end extending into the box. A vertical portion extends down from the distal end of the first lateral portion and a second lateral portion connects a lower end of the vertical portion and a distal end of a base portion. The length $l_1$ of the first lateral portion is greater than the distance $D_1$ between the inner surface of the (Continued)

wall from which the flap extends and the wall of a container being held in the box.

9 Claims, 9 Drawing Sheets

(58) Field of Classification Search
CPC ..... B65D 5/5016; B65D 5/72; B65D 5/725; B65D 5/746; B65D 5/4608; B65D 5/50; B65D 5/42; B65D 5/02; B65D 77/062; B65D 77/06; B65D 5/16; B65D 5/64; B65D 5/0254; B65D 5/4204; B65D 75/52; B65D 5/46; B65D 73/0042; B65D 73/0085; B65D 73/0092; B65D 75/20; B65D 73/0078
USPC .... 206/485, 486, 489, 446, 784, 459.5, 460, 206/736, 756, 769, 775–83, 813, 418; 220/62, 676; 229/122.1, 242, 235, 229/120.011, 194, 125.42, 100; 493/162, 493/84, 241
See application file for complete search history.

(56) References Cited

U.S. PATENT DOCUMENTS

| | | | | |
|---|---|---|---|---|
| 5,372,259 | A * | 12/1994 | Suzuki | B65D 5/5004 206/586 |
| 5,540,330 | A * | 7/1996 | Lo Duca | B65D 5/5014 206/446 |
| 7,237,678 | B2 * | 7/2007 | Lo Duca | B65D 5/4204 206/446 |

FOREIGN PATENT DOCUMENTS

| | | | |
|---|---|---|---|
| CN | 105346855 | A | 2/2016 |
| EP | 0642977 | A1 | 3/1995 |
| EP | 0761550 | A1 | 3/1997 |
| EP | 1479614 | A1 | 11/2004 |
| FR | 2813584 | A1 | 3/2002 |
| FR | 2832132 | A1 | 5/2003 |

OTHER PUBLICATIONS

Supplementary International Search Report, PCT/CN2016/085552, dated Jul. 3, 2018, 9 pages.

* cited by examiner

DISPLAY BOX WITH RETENTION MEANS

TECHNICAL FIELD

The present invention relates to a display box with retention means to prevent rotation and movement of a container held therein. The display box is formed of a single punched and shaped cardboard sheet comprising elongate strips which are folded into a base of the closed box at an angle to a wall of the box to retain a container in position within the box.

BACKGROUND

Many types of display boxes are known and provided with elements which retain and protect a container housed therein. Typically, the base of the container is kept raised from the base of the box to protect it from impact while transporting or storing the boxes. For example, EP-B-0642977 describes a box formed of a single piece of punched and crease-lined cardboard having projecting flaps at one end, these flaps being automatically folded about themselves (on shaping the box) to form supports which are partly glued onto the internal side walls of the box and which perform the function of keeping the container housed in the box and raised and spaced from the base of the box.

EP-A-0761550 describes a display box also formed of a single piece of punched and crease-lined cardboard. As in the prior art, the box has flaps projecting from the base, however, EP '550 differs in that one of the flaps is longer than the length of the box and is adhered to the inside wall of the box at a midway point of the flap and box, such that when the box is closed the parts of the flap that are not adhered fold into the box to form supports at the top and bottom of the container held therein. These boxes hold the container firmly in place, but do not prevent the container from rotating, which means that in some instances, the label on the container may not be shown in the window of the box. EP-A-1479614 describes an alternative box that purports to hold a cylindrical container in place, and prevent rotation of the container about a longitudinal axis. This is done by providing additional sections to the upper flaps with cut-outs provided therein, in which the top edge of the cylindrical container fit, thus preventing rotational motion of the container once in situ. As with EP '550, the container itself is sandwiched between folded portions of the flaps at the top and bottom of the container, suspending the container in position (and thus protecting it from impact).

While the prior art discussed many ways in which a cylindrical container can be kept in place in a display box without damage and without rotation, they all suffer some shortcomings. The present invention seeks to provide improved retention means for keeping a container held in the box in situ, while providing additional benefits, for example, flexibility to use the samebox for different sizes and/or shapes of container and an improved process for positioning a container inside the box.

SUMMARY

According to a first aspect of the invention, there is provided a display box for housing and retaining a cylindrical container, the box comprising:

a) two side walls and a front and rear wall;

b) a top lid extending from an upper end of one of the walls and a bottom lid extending from the lower end of the same or a different wall;

c) at least one elongate flap extending from the lower end of one of said side walls or rear wall, said flap being provided with crease lines along which said flap may be folded, wherein the flap has an end portion adhered to the inner surface of the wall from which the flap extends, a first lateral portion having a proximal end adjacent the wall and a distal end extending into the box, a vertical portion extending down from the distal end of the first lateral portion, a second lateral portion connecting a lower end of the vertical portion and a distal end of a base portion, wherein the length of the first lateral portion is greater than the distance between the inner surface of the wall from which the flap extends and the wall of a container being held in the box.

In use, once the container has been inserted in the box, the flap is moved into a closed position where the second lateral portion pushes against a base of the container and a distal end of the first later portion pushes against the side of the container. As the first lateral portion is longer than the distance between the inner surface the wall from which the flap extends and the side of the container, when the box is closed, the first lateral portion is angled relative to the inner surface of the side wall and presses against the distal end of the first lateral portion, thus retaining the container in position.

Preferably, one or both of the distal end of the first lateral portion and the top end of the substantially vertical portion is provided with a cut-out, where an edge of the or each cut-out extends into the box beyond the side of the container being held therein. This helps retain the cylindrical container in position as the container fits in the cut-out when the box is closed, thus providing multiple contact points between the flap and the container.

Preferably, the base portion has a length greater than the distance between the inner side wall of the box and an edge of the base of the container. As a result, the second lateral portion provides a shelf on which the container may sit when the box is closed.

Preferably, a second flap is provided extending from the lower end of the side wall opposite that of the first flap featuring mirror creases and portions. Thus, when the box is closed, the container is pressed against from opposing sides further securing it in place.

Further flap(s) may extend from the upper end of one or both of the side walls. Each of the upper flaps is provided with an end portion that is adhered to the inner surface of the side wall from which the flap extends; a first lateral portion extending from the end portion and a second later portion extending from the upper end of the side wall; and a vertical portion extending between distal ends of both lateral portions.

BRIEF DESCRIPTION OF THE DRAWINGS

While the specification concludes with claims, it is believed that the same will be better understood from the following description taken in conjunction with the accompanying drawings in which:

DETAILED DESCRIPTION

It has surprisingly been found by the inventor of the present invention that by providing a box for holding and displaying a container with a flap extending from a lower end of a side wall of the box with a lateral portion extending from the inner side wall into the box that is longer than the distance between the inner wall and the container, it is possible to provide force against a container held in the box in such a way that the container is securely held in position. This prevents the container from being displaced and/or rotating such that the container is no longer displayed correctly.

Figure 1:
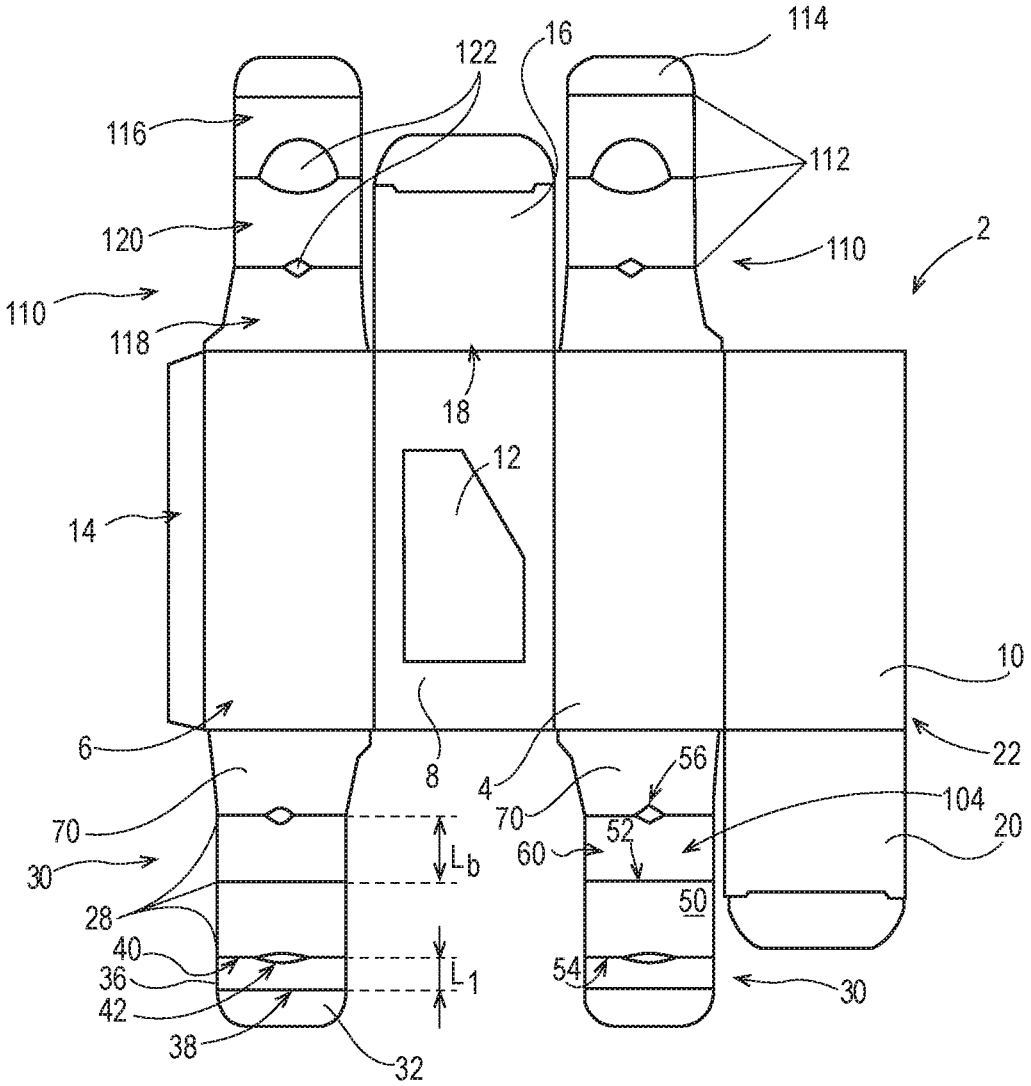
FIG. 1 is a spread-out plan view of a punched and crease-lined cardboard sheet intended to form a box of the present invention, as seen from the interior of the box.

FIG. 1 shows a spread-out plan view of a box 2 of the present invention. The box has two side walls 4, 6 and front 8 and rear 10 walls. The front wall 8 has a window 12 through which a container (not shown in FIG. 1) held inside the box 2 may be seen. An elongated portion 14 is provided along the length of one of the side walls (6) for adhesion to the rear wall 10 to complete the box 2. It will be appreciated that the plan view of the box 2 shown in FIG. 1 is open between one of the side walls 6 and the rear wall 10. In an alternative embodiment, the box 2 may be open between two other adjacent walls, in which case the elongated portion 14 would be provided on the outside of at least one of the open walls.

A top lid 16 extends from the upper end 18 of one of the walls 4, 6, 8, 10 and a bottom lid 20 extends from the lower end 22 of one of the walls 4, 6, 8, 10. In the embodiment shown in FIG. 1, the top lid 16 extends from the front wall 8 and the bottom lid extends from the rear wall 10. A creased and foldable flap 30 extends from the lower end 22 of one of the side walls 4, 6 or rear wall 10 (but not the wall from which the lower lid extends). The foldable flap 30 is provided with crease lines 28 along which the flap 30 may be folded. The crease lines 28 are substantially parallel to the base of the wall from which the flap extends.

Figure 2:
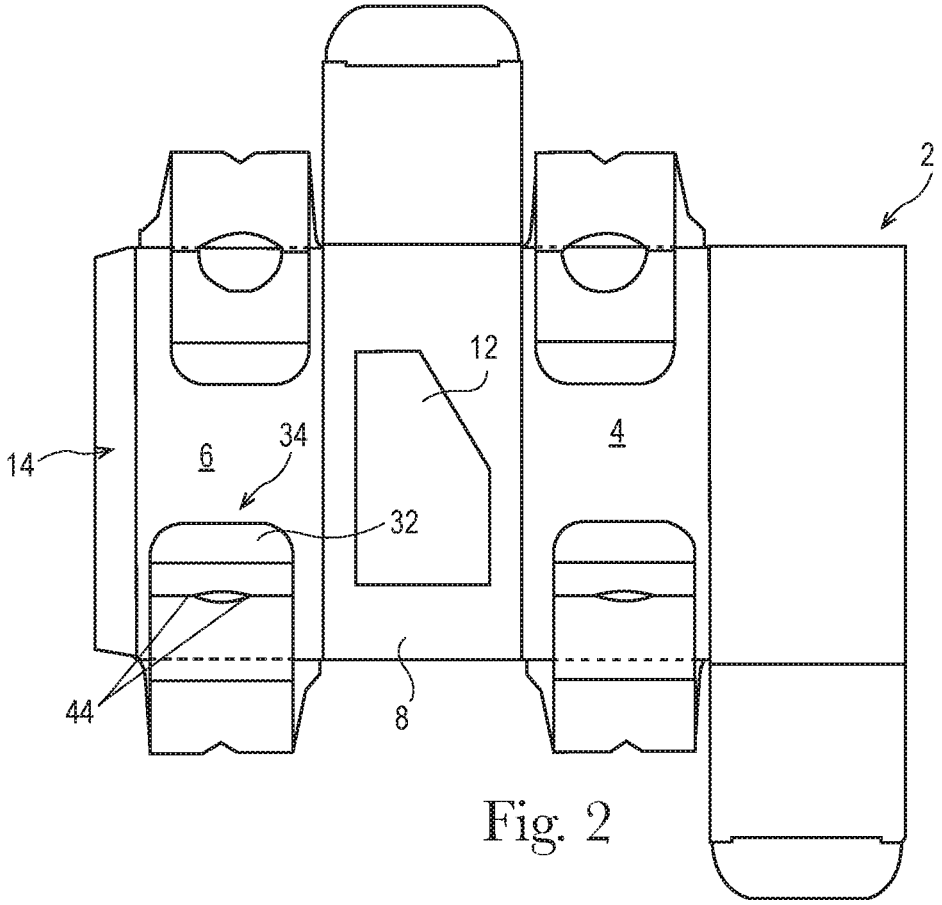
FIGS. 2 to 4 show the same cardboard sheet in its various successive stages of folding and gluing.
Figure 3:
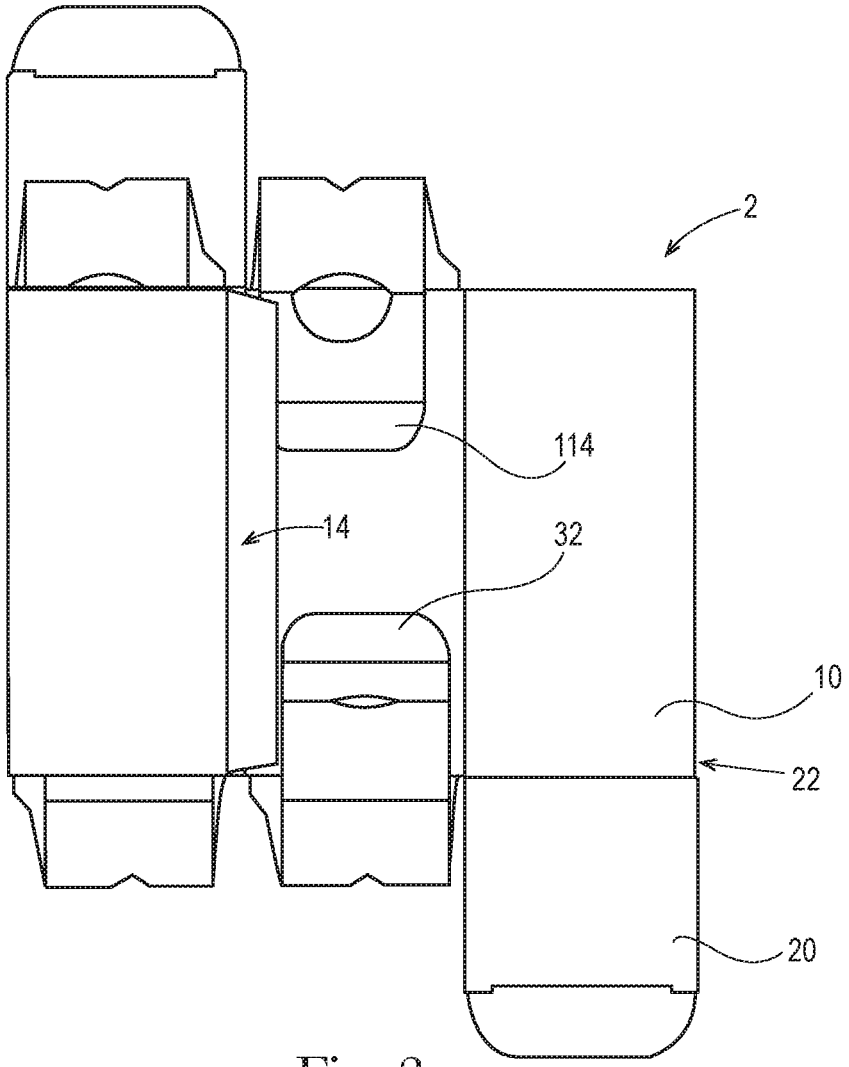
Figure 4:
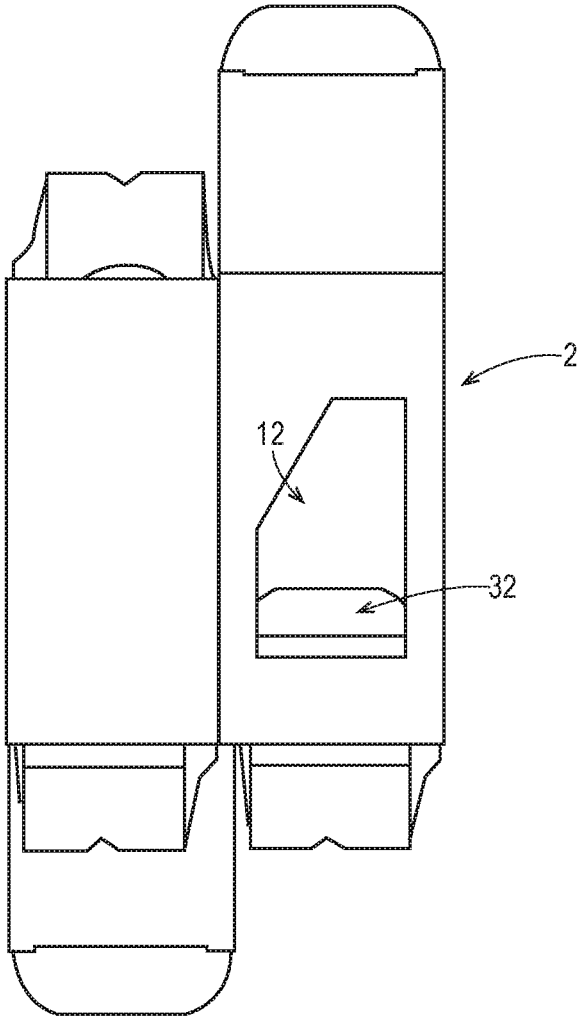
Figure 5:
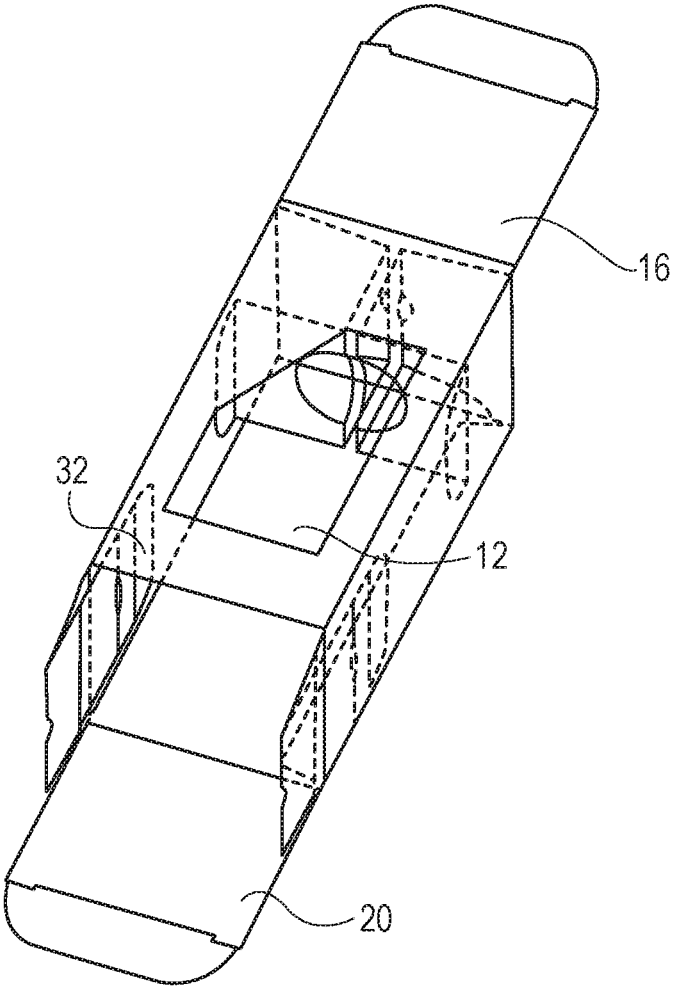
FIGS. 5 to 7 show perspective views of the finished box, showing the interior arrangement of the flap(s) when the box is closed.
Figure 6:
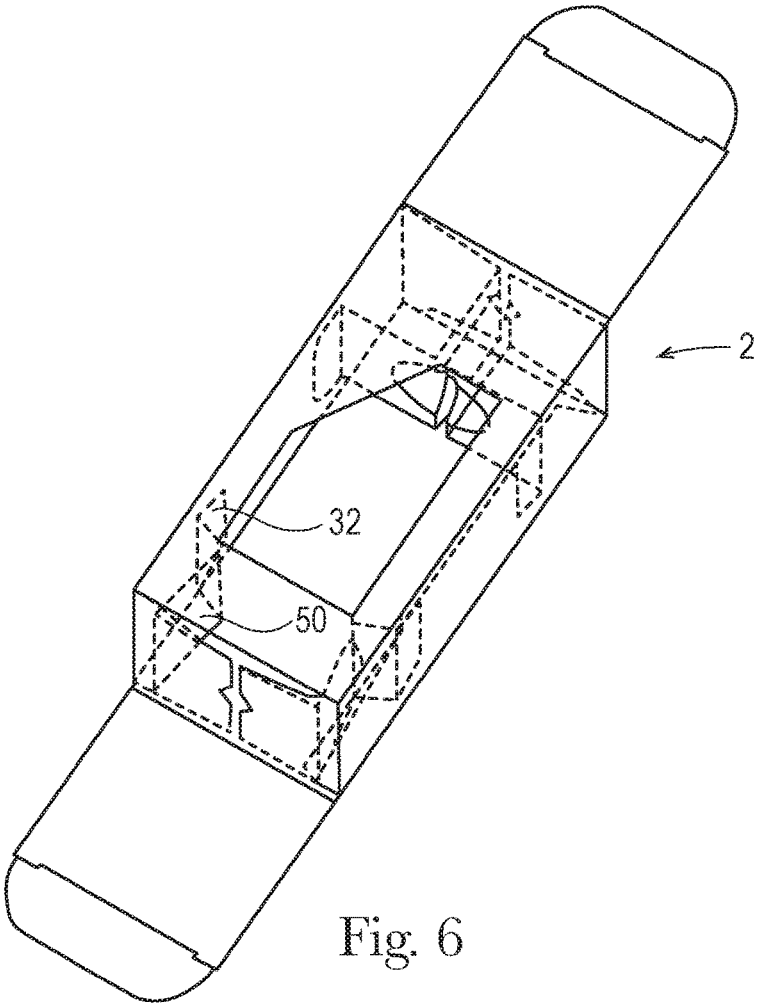
Figure 7:
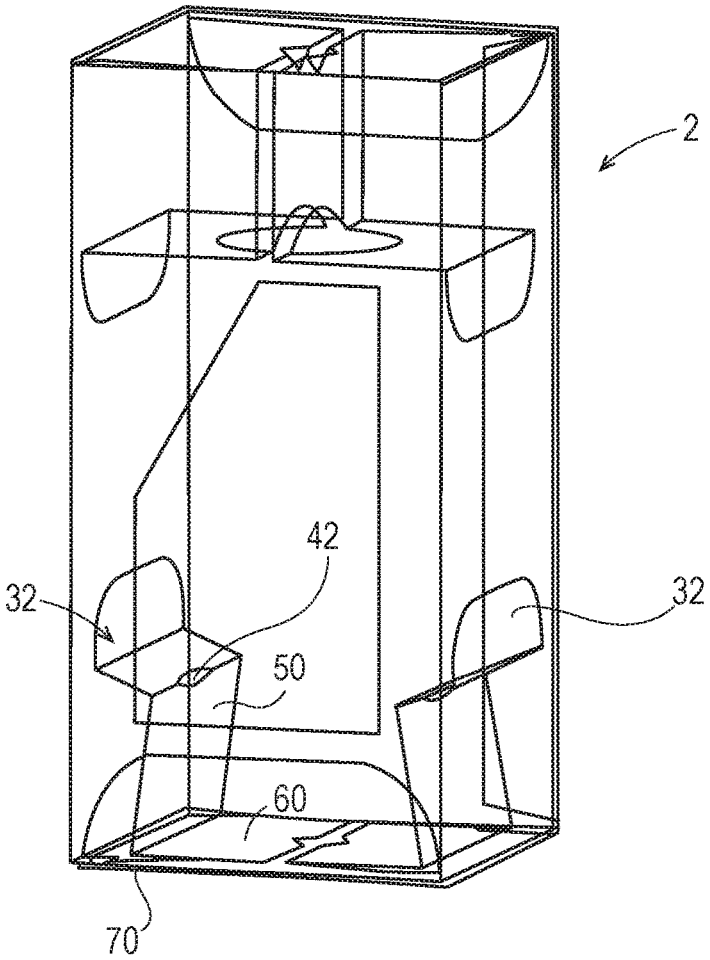
Figure 8:
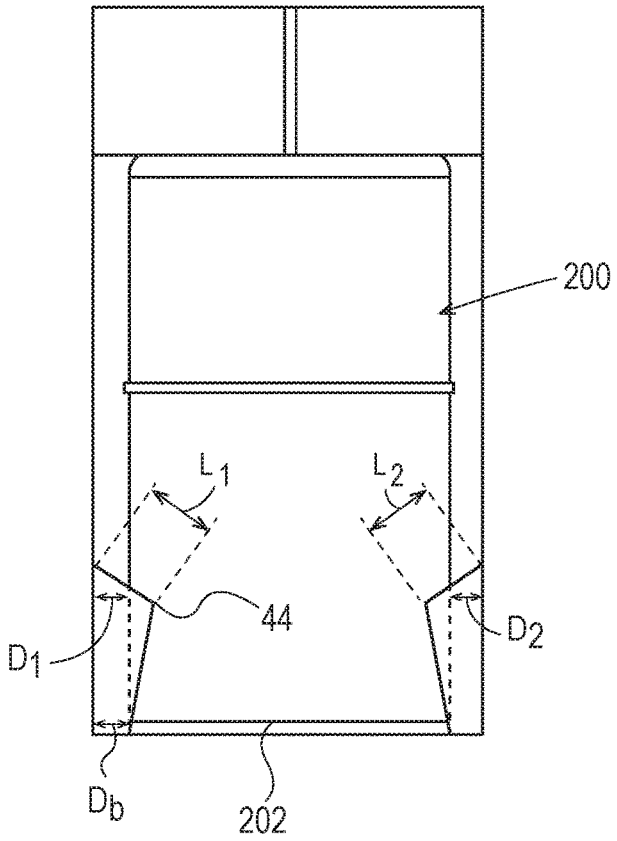
FIG. 8 shows a closed box of the present invention with a container in situ.
Figures 9A, 9B, 9C, 9D:
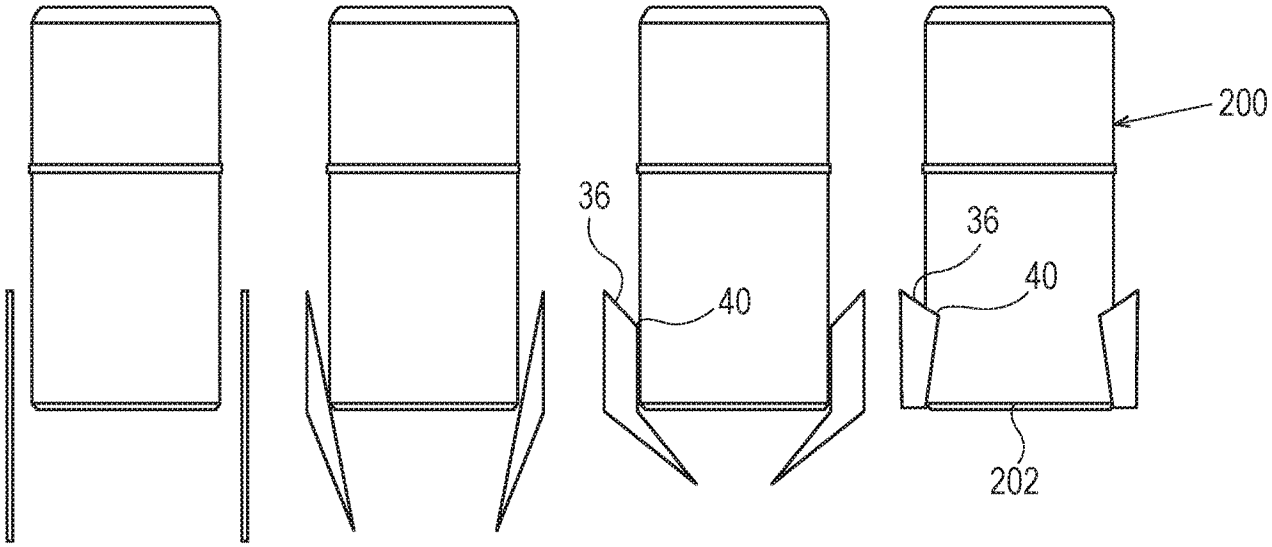
FIGS. 9A, 9B, 9C, and 9D show how the flaps of the box are moved from a flap-pack position to hold a container in place during packing.

The flap 30 has an end portion 32 which, in assembled form, is adhered to the inner surface 34 (shown in FIG. 2) of the wall 4, 6, 10 from which the flap 30 extends. The flap may be adhered to the inner surface of the box by any known means, however, in a preferred embodiment, glue spots are provided on the end portion ahead of assembly of the box. A first lateral portion 36 extends from the end portion 32 of the flap 30 and has a proximal end 38 adjacent the inner surface of the wall 4, 6, 10 and a distal end 40 arranged to contact the container held within the box 2. The first lateral portion 36 has a length $L_1$ greater than the intended distance $D_1$ (shown in FIG. 8) between the inner surface of the wall and the wall of the container. In an embodiment, a cut-out portion 42 is provided at the distal end 40 of the first lateral portion for securing the container in position. In the embodiment shown, the cut-out has a substantially rhomboidal profile, but in other embodiments, the cut-out may have a semi-circular or triangular profile. The cut-out portion preferably has a shape that conforms to the external surface of a container being carried within the box. For example, in the case of a cylindrical container, the cut-out may take the form of a semi-circle so that the cut-out makes contact with the container at multiple points. An edge 44 of the cut-out extends into the box beyond the edge of the container held therein. Thus, the distal end of the first lateral portion makes contact with the container at multiple points along the cut-out, increasing the friction and pressure upon the container that further helps to retain it in position.

A substantially vertical portion 50 of the flap 30 extends from the distal end 40 of the first lateral portion. In assembled form, the vertical portion 50 has an upper end 52 adjacent the distal end 40 of the first lateral portion that contacts the container and a lower end 54 inclined away from the container. In an embodiment, the upper end of the vertical portion has a cut-out portion 56 for securing the container in position. The cut-out portion 56 may take the form of a semi-circle.

A second lateral portion 60 connects the lower end 54 of the vertical portion 50 with a distal end of the base portion 70 that extends from the lower end of the wall. When assembled, the base of the container sits on the second lateral portion 60. The base portion has a length $l_b$ greater than the distance $D_b$ (shown in FIG. 8) between the inner surface of the wall and the base of the container.

When the box is assembled with container in situ, the base portion sits flush with the bottom end of each wall of the box and the first lateral portion, vertical portion and second lateral portion substantially form a z-shape. As the box is closed and the flap moved into assembled position, as shown schematically in FIGS. 9A, 9B, 9C, and 9D, the distal end of the first lateral portion moves upwards and away from the inner surface of the wall towards the container. As the length $l_1$ of the first lateral portion is greater than the distance between the inner surface of the wall and the container, as it moves, the first lateral portion will press against the side of the container. Where the container is not yet in position, this force will assist in moving the container to the correct position, pressing against the opposing wall. Once the container is in position, the distal end of the first lateral portion applies a constant force against the container, retaining it in a fixed position. In this position, the first lateral portion will be at least slightly angled downwards from the inner surface of the wall to which the end portion of the flap is attached.

In an embodiment, a single flap is provided for positioning and retaining the container in place (preferably in the window of the front wall). In an alternative embodiment, at least one further flap 100 is provided to extend from a lower end of the opposing wall. Thus, assuming the first flap extends from a side wall 4, the second flap will extend from the opposing side wall 6. In this case, the second flap may be a mirror image of the first flap and may provide additional support from the opposite side. In an alternative embodiment, as shown in FIGS. 1 to 7, where the container is located adjacent the opposing side wall, the first lateral portion 102 of the second flap is shorter than the first lateral portion of the first flap. In both embodiments, the first lateral portion 102 of the second flap 100 still has a length $L_2$ (shown in FIG. 8) greater than the distance between the inner surface of the opposing side wall and the wall of the container. Where the base portion of both flaps is the same length and first lateral portion of the second flap is shorter than that of the first flap, the second lateral portion 104 of the second flap 100 may be longer than that of the first flap.

In all embodiments, once the container has been placed in the box and the first and second flaps folded to retain the container in position, the bottom lid 20 may be folded over to secure the base portion of each flap in place (thus preventing the weight of the container from displacing either or both of the flaps).

In an embodiment, a window 12 is provided in at least the front wall. In a preferred embodiment, the window may extend over at least one of the side walls. Where the window extends over a side wall, it is anticipated that the first flap provided for positioning and retaining the container in position extends from the side wall opposite the window and, if there is a second flap, it extends from the lower end of the side wall bearing the window. The lower lid may extend from either the front wall or rear wall.

In the present invention, the container is loaded into the box from below. In embodiments, the upper lid 16 provides a top surface against which the container may rest when located inside the box. Alternatively, one or more upper supports 110 may be provided in the form of one or more foldable flaps extending from the upper ends 18 of the side walls. These upper foldable flaps are provided with crease lines 112 that enable them to be folded into position. In a preferred embodiment, an identical (but opposing) foldable flap extends from an upper end of each side wall. Each flap has an end portion 114 for securing to the inner surface of the side wall. A first lateral portion 116 extends from the end portion at approximately 90° into the box to form an internal top surface upon which the container can push when in situ. A second lateral portion 118 is provided extending from the upper end of the side wall at approximately 90° into the box substantially in parallel with the first lateral portion. A vertical portion 120 connects the first and second lateral portions and the two vertical portions of the opposing flaps rest against one another when the box has been formed. This adds additional structure to the box. A cut out 122 is provided at a distal end of each of the lateral portions and at either end of the vertical portion. In the embodiment shown in FIGS. 1 to 7, the cut-outs are shown to be semi-circular. However, it will be appreciated that the cut-outs may take any known shape, e.g., rhomboidal, triangular, etc. The upper lid is secured over the top of the two upper flaps once they have been folded into position.

In practice, the cardboard cut-out would be stamped as a single piece and crease lines provided. The box is then folded into position, as shown schematically throughout FIGS. 2 to 7. First the upper and lower flaps are folded and the end portions of each flap adhered in position to the inner surface of the box. Subsequently the upper flaps are pushed down to form squares or rectangles before the lower lid is closed. In an embodiment, glue may be provided on the outer surface of the vertical portions of one or both flaps and or on the outer surface of one or both of the second lateral portion. In the event glue is applied, the two vertical portions will adhere to one another and the upper lid will adhere to the second lateral portion of the different flaps, thus improving the structural integrity of the box.

Thereafter the side walls of the box are folded in to form a tube with rectangular cross-section and the elongate portion is adhered to the inner surface of the rear wall. The container is then positioned inside the box in the window area (as it is intended to be seen on shelf) and the lower flap (or flaps where there are two) is folded upwards, at which point tension should be felt on the lower flap indicating that the container is secured in position. Thereafter, the lower lid is secured in position. In an embodiment, glue may be applied to an external surface of the second lateral portion of the lower flap such that when the lower lid is closed, the lower lid and flap are adhered to one another.

As the lower flap is designed to be angled when in situ, it is possible to use the same box for different sizes of container, provided that the first lateral portion of the lower flap is longer than the intended distance between the inner surface of the side wall and the side of the container. This improves the flexibility of use of such a cardboard box with different containers.

In an embodiment, the box is formed of, for example, paperboard, cardboard, plastic board, corrugated board or any material board that could be folded to a certain shape.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A display box for housing and retaining a cylindrical container, the box comprising:

a) two side walls and a front and rear wall;

b) a top lid extending from an upper end of one of the walls and a bottom lid extending from the lower end of the same or a different wall;

c) an elongated flap extending from the lower end of one of said side walls or rear wall, the flap being provided with crease lines along which the flap may be folded, wherein the flap has an end portion adhered to the inner surface of the wall from which the flap extends, a first lateral portion having a proximal end adjacent the wall and a distal end extending into the box, a vertical portion extending down from the distal end of the first lateral portion and including a lower end inclined away from the cylindrical container when retained in the box, a second lateral portion connecting the lower end of the vertical portion and a distal end of a base portion, wherein the length L1 of the first lateral portion is greater than the distance $D_1$ between the inner surface of the wall from which the flap extends and the wall of the cylindrical container retained in the box.

2. The display box of claim 1, wherein one or both of the distal end of the first lateral portion and the top end of the substantially vertical portion is provided with a cut-out, where an edge of the cut-out extends into the box beyond the side of the container being held therein.

3. The display box of claim 2, wherein the cut-out has a shape arranged to conform with an external surface of the container being held therein.

4. The display box of claim 1, wherein the base portion has a length $l_b$ greater than the distance $D_b$ between the inner side wall of the box and an edge of the base of the container.

5. The display box of claim 1, further comprising a second flap extending from the lower end of the side wall opposite that of the first flap, said second flap featuring creases and portions that are generally symmetrical to the first flap.

6. The display box of claim 5, wherein the second flap has a first lateral portion having a length $L_2$ greater than the distance between the inner surface of the wall from which the second flap extends and an opposing side of the container being held therein.

7. The display box of claim 6, wherein $L_1$ is greater than $L_2$.

8. The display box of claim 1, further comprising one or more further flap(s) extending from the upper end of one or both of the side walls and having an end portion that is adhered to the inner surface of the side wall from which the flap extends; a first lateral portion extending from the end portion and a second lateral portion extending from the upper end of the side wall; and a vertical portion extending between distal ends of both lateral portions.

9. The display box of claim 1, wherein the box is formed of a single piece of punched material selected from the group consisting of paperboard, cardboard, plastic board, corrugated board etc.

* * * * *